United States Patent [19]

Hoffmann et al.

[11] 4,344,016

[45] Aug. 10, 1982

[54] FLUORESCENT LAMP WITH SILICON DIOXIDE COATING

[75] Inventors: Roland Hoffmann; Ernst Panofski, both of Augsburg, Fed. Rep. of Germany

[73] Assignee: Patent-Treuhand-Gesellschaft fur elektrische Gluhampen mbH, Munich, Fed. Rep. of Germany

[21] Appl. No.: 123,962

[22] Filed: Feb. 25, 1980

[30] Foreign Application Priority Data

Mar. 7, 1979 [DE] Fed. Rep. of Germany ..... 2908890

[51] Int. Cl.[3] ..... H01J 61/35; B05D 5/06

[52] U.S. Cl. ..... 313/489; 313/493; 427/67

[58] Field of Search ..... 313/489, 493; 427/67

[56] References Cited

U.S. PATENT DOCUMENTS

| | | | |
|---|---|---|---|
| 2,686,157 | 8/1954 | Jones | 427/67 |
| 2,838,707 | 6/1958 | Schwing et al. | 427/67 X |
| 3,205,394 | 9/1965 | Ray | 313/489 |
| 3,547,680 | 12/1970 | Bouchard et al. | 427/67 |
| 4,058,639 | 11/1977 | Schreurs | 427/67 |
| 4,148,935 | 4/1979 | Schreurs | 427/67 |

*Primary Examiner*—Palmer C. Demeo

*Attorney, Agent, or Firm*—Frishauf, Holtz, Goodman & Woodward

[57] ABSTRACT

An improved low pressure mercury vapor discharge lamp, particularly of the fluorescent type. The inner wall of the glass envelope is coated with a layer of $SiO_2$ particles which, in turn, is coated with a phosphor layer. The $SiO_2$ particles have a particle size of below about 100 nm. The $SiO_2$ particle containing layer containing between 0.5 and 0.7 mg of $SiO_2$ particles per square centimeter of glass envelope which is coated.

8 Claims, 5 Drawing Figures

FLUORESCENT LAMP WITH SILICON DIOXIDE COATING

BACKGROUND OF THE INVENTION

The invention provides an improved low pressure mercury vapor discharge lamp, in particular a fluorescent lamp, comprising a glass envelope with an inner wall phosphor coating and with a silicon dioxide ($SiO_2$) coating between the phosphor coating and the envelope.

It is known to apply to the inner wall of the lamp envelope a continuous, three-dimensional film of a structure of bonded silicon and oxygen atoms (NL-PA 68 13 725). It is a homogeneous coating of a thickness of preferably 0.1 'to 0.4μ. The coating is intended to prevent a reaction between the mercury in the lamp and the alkaline components contained in the glass wall which, if the reaction occurred, would result in the production of amalgam and cause a blackening of the envelope, and thus an accelerated reduction of the light out-put and shortening of the lamp life.

It is the subject of the invention to improve the lamp with respect to luminous efficacy, luminous flux and production costs by means of a silicon dioxide intermediate coating.

THE INVENTION

The low pressure mercury vapor discharge lamp, in particular a fluorescent lamp, comprising a glass envelope with a phosphor coating on the inner wall and with a coating of silicon dioxide ($SiO_2$) between the phosphor coating and the envelope, is characterized in that the $SiO_2$-coating is granular and has a thickness of between 0.05 and 0.7 mg/cm$^2$. The particle size of the $SiO_2$ granules is below 100 nm.

The amalgam produced in prior art lamps resulting from reaction of mercury with the alkaline components of the glass is prevented in lamps according to the present invention by means of a $SiO_2$-coating. In addition to the dense glass wall coating having hardly any porosity, and the thus effected screening against the mercury atoms, surprisingly, an optical effect of the coating results from suitable dimensioning of the $SiO_2$-coating. With a coating thickness according to the invention of between 0.05 and 0.7 mg/cm$^2$, preferably between 0.08 and 0.4 mg/cm$^2$, and a particle size smaller than 100 nm, there are $10^{12}$ to $10^{15}$ diffusion centers per cm$^2$, the diameter of which lies below the wavelength of visible light, and also clearly below the wavelength of UV-radiation produced by the discharge. Coatings of a thickness between 0.15 and 0.2 mg/cm$^2$ produce particularly good results.

Although the packing density of the diffusion centers is very high, the luminance behavior of this coating can approximately be described by the Raleigh scatter. The portion of the luminance radiation therefore changes with $\lambda^{\frac{1}{4}}$, i.e., with the 4th power of the wavelength; the luminance increasing as the wavelength of the incident radiation becomes smaller. This effect is very advantageous because the mercury discharge contains, in addition to 254 nm radiation, a considerable portion (approximately 10% of the UV-radiation) of 185 nm radiation, and thus this shortwave portion is also to a great extent reflected into the phosphor coating and cannot penetrate to the envelope wall. In the case of lamps without luminance coating, approximately 30% to 50% of the 185 nm radiation is destroyed at the glass wall since, in general, this radiation is only poorly absorbed by the phosphor coating.

In particular, lamps of reduced diameter (preferably of 26 mm diameter) show the advantageous effect of the $SiO_2$ coating, since with these lamps the UV-radiation density increases by approximately 30% at the location of the phosphor material and at the glass wall due to the higher current density and the reduced area covered with phosphor material.

The combination of a $SiO_2$-coating with a three band phosphor material as applied in lamps known under the trademark Lumilux is of particular advantage.

The application of the $SiO_2$-coating in the thickness according to this invention also permits a reduction of the amount of phosphor material which is needed. This is due to the great diffusion capacity of the $SiO_2$-coating according to the invention in the UV-range, causing a portion of the luminance UV-radiation to be directed back into the phosphor material.

The increased utilization of the UV-radiation when a $SiO_2$-coating of a thickness of 0.05 to 0.7 mg/cm$^2$ is on the glass envelope also results in higher luminous efficacies. With thinner coatings, it is impossible to obtain the necessary number of diffusion centers. With thicker coatings, an observable amount of absorption of the visible light occurs, causing a reduction in the luminous efficacy.

THE DRAWINGS

The invention, which can be utilized in all fluorescent lamps, is illustrated by means of the exemplified embodiments in FIGS. 1, 2, 3, 4 and 5.

Figure 1:
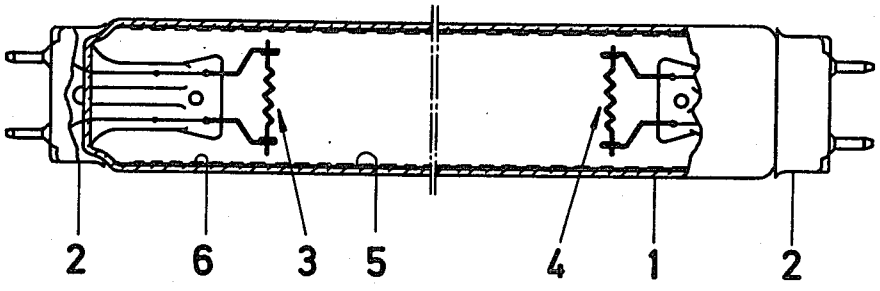
FIG. 1 depicts a plan view of a lamp.
Figure 2:
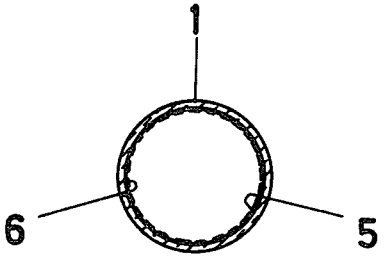
FIG. 2 depicts a cross-section of the lamp.

The lamp depicted in FIG. 1 comprises a glass envelope 1 of a diameter of preferably 26 mm, each end 2 of said envelope being provided with a sealed-in electrode 3, 4. A coating 5 of highly dispersed $SiO_2$ particles having an approximate thickness of 0.18 mg/cm$^2$ is applied to the inner wall of the envelope 1 (FIG. 2), said coating consisting of 40 to 70 layers of particles of a diameter smaller than 100 nm. This coating, in turn, is covered by the usual phosphor coating 6 of, e.g., halophosphates, three band phosphor materials, among others. Before applying the phosphor coating, the inner surface of the envelope is wetted with a suspension of $SiO_2$-powder, binder and solvent. Nitrocellulose has proven to be suitable as binder and butylacetate as solvent, or polymethacrylate as binder and water as solvent.

Figure 3:
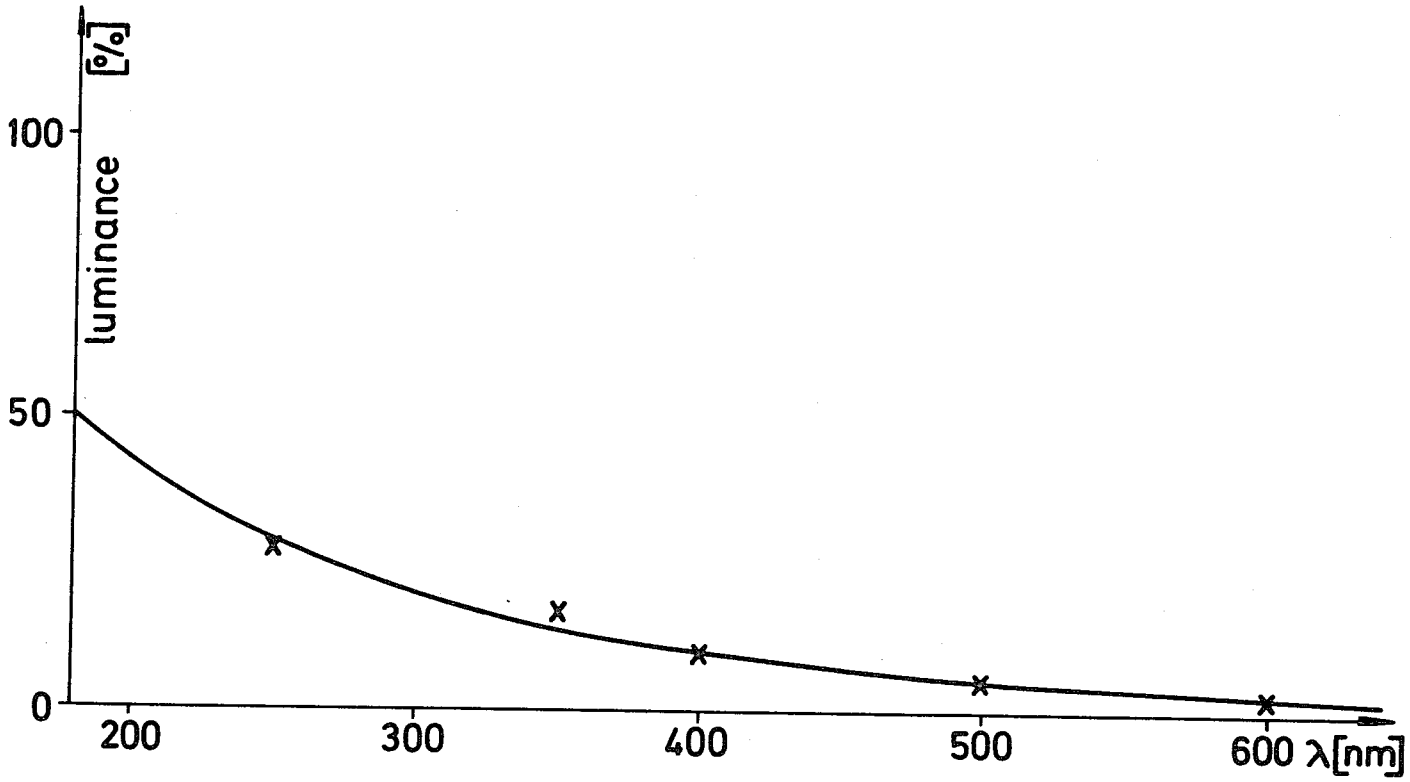
FIG. 3 is a graph of luminance as a function dependent upon the wavelength λ.
Figure 4:
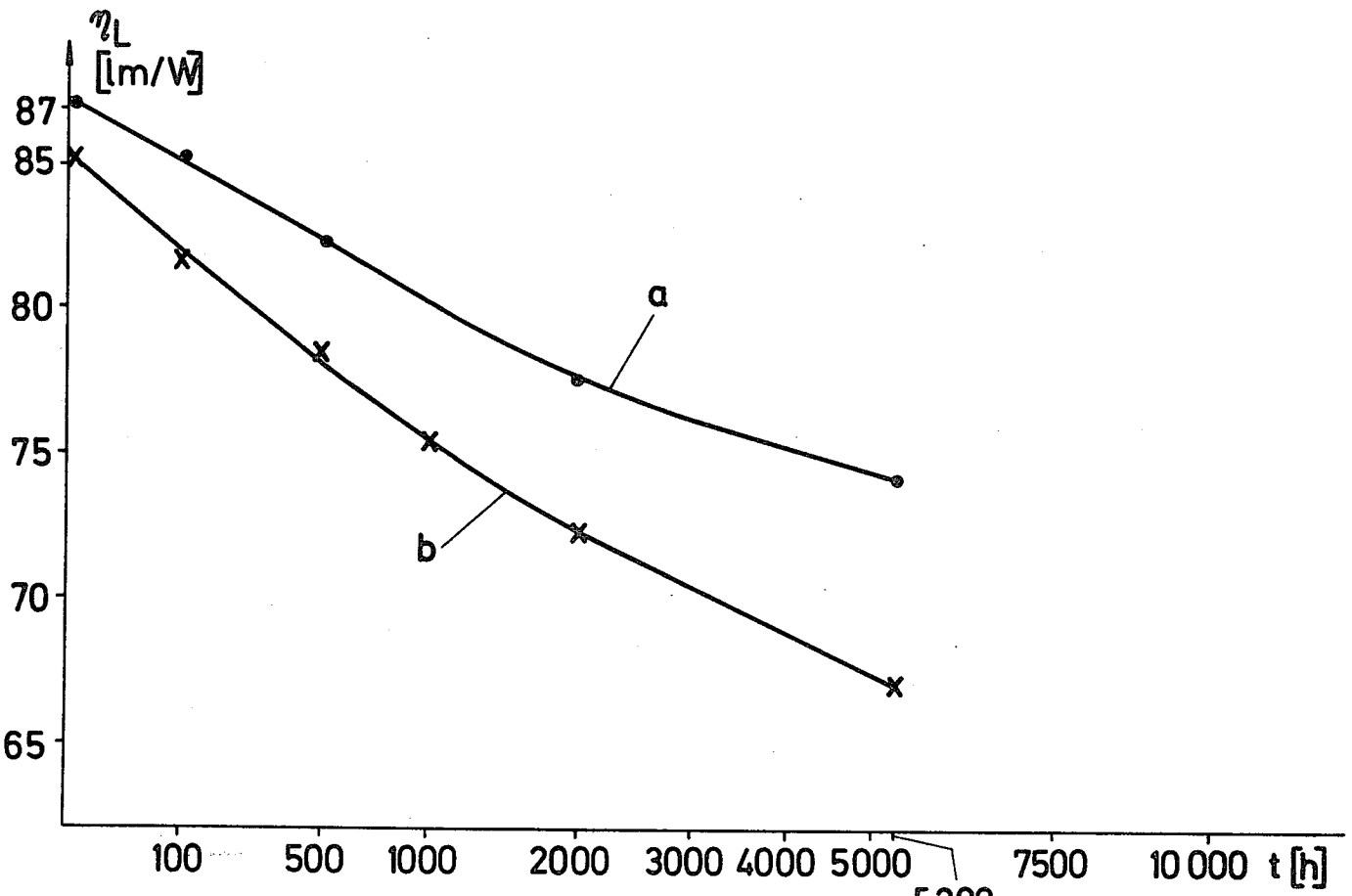
FIG. 4 is a graph of the luminous efficacy $\eta_L$ as a function dependent upon the operating time t in hours h.

FIG. 3 reports that the luminance for the $SiO_2$ coating according to the invention is approximately 50% for the 185 nm radiation and approximately 30% for the 254 nm radiation. FIG. 4 reports the effect of the $SiO_2$-coating (curve a) with respect to the luminous efficacy $\eta_L$ in lm/W. Curve b reports the corresponding data for a lamp without the $SiO_2$-coating. After 5,000 hours of operation, the luminous efficacy reported by curve a increases to approximately 10% with respect to curve b.

Figure 5:
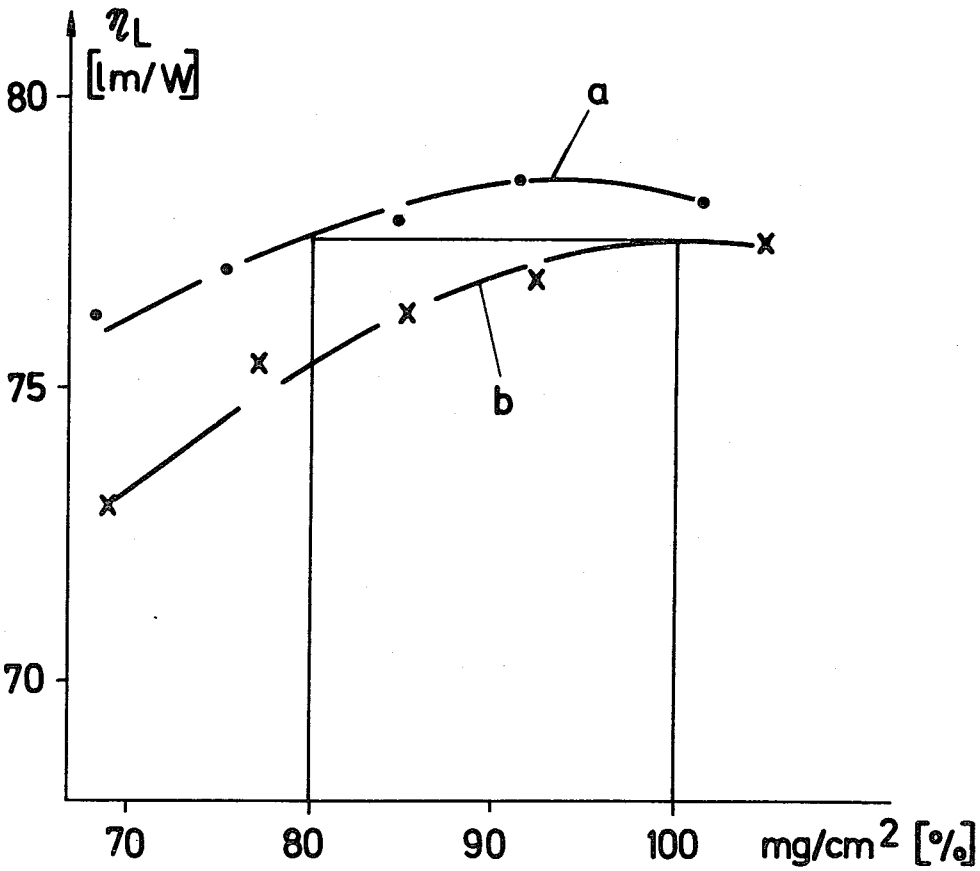
FIG. 5 shows the luminous efficacy $\eta_L$ as a function dependent on the weight of the coating of the phosphor material mg/cm$^2$ in %.

In FIG. 5, the curve a reports data for a lamp with a $SiO_2$-coating according to this invention, and a curve b for a lamp without this coating. FIG. 5 shows clearly that the maximum of the luminous efficacy $\eta_L$ in lm/W shifts toward lower phosphor coating weight. About 10% of the phosphor material can be saved by the application of the $SiO_2$-coating according to the invention, with the added benefit that the luminous efficacy is increased when compared to the usual fluorescent lamp types that do not have the coating according to this invention. When improved luminous efficacy is not sought, up to 20% of the phosphor material can be saved per lamp.

The designation of the thickness of the $SiO_2$ particle containing coating on the inside of the glass envelope is in terms of the weight of $SiO_2$ particles in said coating layer per square centimeter of the glass envelope which is coated.

The $SiO_2$ coating is applied by wetting the inner surface of the envelope with a suspension of the $SiO_2$ particles in the polymeric binder which also contains solvent. The relative proportion by weight of $SiO_2$ particles to binder is between 100:1 and 100:35, and preferably between 100:3 and 100:20. The content of solid material ($SiO_2$) in the paste is between about 0.2 and 8 percent by weight of the coating composition and preferably between 0.8 and 5 percent by weight.

The lower limit for the $SiO_2$ particle size is at about 2 nm. The primary particles have preferably a size of from 7 to 20 nm, the agglomerates preferably of from 10 to 70 nm. As a three band phosphor material is suited a known phosphor which consists of europium-activated yttrium oxide, terbium-activated cerium magnesium aluminate and europium-activated barium magnesium aluminate.

What is claimed is:

1. An improved low pressure mercury vapor discharge lamp, comprising a glass envelope having an electrode at each end with an inner wall phosphor coating substantially completely covering a coating of silicon dioxide $SiO_2$ which is between the phosphor coating and the envelope, the improvement comprising the $SiO_2$ in said coating being in the form of $SiO_2$ particles having a particle size between about 2 and 100 nm and said $SiO_2$ particles containing coating being in an amount between 0.05 and 0.7 mg of $SiO_2$ particles in said coating per square centimeter of glass envelope which is coated.

2. The low pressure mercury vapor discharge lamp of claim 1, wherein said $SiO_2$ particle-containing coating is in an amount between 0.08 and 0.4 mg/cm$^2$.

3. The low pressure mercury vapor discharge lamp of claim 1, wherein said $SiO_2$ particle-containing coating a thickness between 0.15 and 0.2 mg/cm$^2$.

4. A method of manufacturing a low pressure mercury vapor discharge lamp according to claim 1 or 2 or 3, characterized in that said $SiO_2$ particle-containing coating is formed on the inner surface of the glass envelope by wetting said inner surface with said amount of $SiO_2$ coating in the form of a suspension of $SiO_2$-powder in binder and solvent and then applying the phosphor coating.

5. The method of claim 4, wherein said $SiO_2$ is present in the binder in a weight ratio or $SiO_2$: binder between 100:1 and 100:35.

6. The method of claim 4, wherein said $SiO_2$ is present in the binder in a weight ratio of $SiO_2$: binder between 100:3 and 100:20.

7. The low pressure mercury vapor discharge lamp of any one of claims 1, 2 or 3, wherein the particle size of said $SiO_2$ particles is between 7 and 20 nm.

8. The low pressure mercury vapor discharge lamp of claim 7, wherein said particles of $SiO_2$ form agglomerates of the size between 10 and 70 nm.

* * * * *